US009919407B2

(12) United States Patent
Gottardelli

(10) Patent No.: US 9,919,407 B2
(45) Date of Patent: Mar. 20, 2018

(54) FLEXIBLE ABRASIVE FOR POLISHING SURFACES

(71) Applicant: ABRA ON S.R.L., Legnago (IT)

(72) Inventor: Michele Gottardelli, Legnago (IT)

(73) Assignee: ABRA ON S.R.L., Legnago (IT)

( * ) Notice: Subject to any disclaimer, the term of this patent is extended or adjusted under 35 U.S.C. 154(b) by 132 days.

(21) Appl. No.: 14/905,381

(22) PCT Filed: Jul. 14, 2014

(86) PCT No.: PCT/IB2014/063094
§ 371 (c)(1),
(2) Date: Jan. 15, 2016

(87) PCT Pub. No.: WO2015/008210
PCT Pub. Date: Jan. 22, 2015

(65) Prior Publication Data

US 2016/0151888 A1 Jun. 2, 2016

(30) Foreign Application Priority Data

Jul. 18, 2013 (IT) ..... VR2013A0167

(51) Int. Cl.

| | |
|---|---|
| ***B24D 11/02*** | (2006.01) |
| ***B24D 11/04*** | (2006.01) |
| ***B24D 11/00*** | (2006.01) |
| ***B24B 37/26*** | (2012.01) |
| ***B24D 3/34*** | (2006.01) |
| ***B24D 3/28*** | (2006.01) |

(52) U.S. Cl.
CPC ..... *B24D 11/005* (2013.01); *B24B 37/26* (2013.01); *B24D 3/28* (2013.01); *B24D 3/348* (2013.01); *B24D 11/001* (2013.01); *B24D 11/02* (2013.01); *B24D 11/04* (2013.01)

(58) Field of Classification Search
CPC ..... B24D 11/005; B24D 11/02; B24D 11/04; B24D 11/001; B24D 3/28; B24D 3/348
See application file for complete search history.

(56) References Cited

U.S. PATENT DOCUMENTS 3,656,265 A 4/1972 Schaffner, Jr.
5,607,345 A * 3/1997 Barry ..... A44B 18/0003 451/526

(Continued)

FOREIGN PATENT DOCUMENTS

WO 0104227 A2 1/2001
WO 2011087653 A1 7/2011
WO WO 2011/087653 * 7/2011 ..... B24D 11/00

*Primary Examiner* — Pegah Parvini
(74) *Attorney, Agent, or Firm* — Ference & Associates LLC

(57) ABSTRACT

A flexible abrasive (10) with a preset shape corresponding to the shape of the operating head of a machine tool such as a sanding machine and comprising a first support (16) made from a woven or non-woven material where a lower surface can be fixed to a backing plate or a pad of the operating head. The abrasive surface is made from at least two strips (20-23) applied side by side and parallel to each other and where the second support (11) of each strip (20-23) is separately fixed on the first support (16), and where the abrasive surface (18) is shaped so that it can be applied to the backing plate or pad of the operating head.

11 Claims, 2 Drawing Sheets

(56) References Cited

U.S. PATENT DOCUMENTS

| | | | | |
|---|---|---|---|---|
| 5,725,420 | A * | 3/1998 | Torii | B24B 37/26 451/285 |
| 6,682,402 | B1 | 1/2004 | Roberts et al. | |
| 2002/0090901 | A1 * | 7/2002 | Schutz | B24D 3/004 451/526 |
| 2011/0237165 | A1 | 9/2011 | Zyniecki | |

* cited by examiner

FLEXIBLE ABRASIVE FOR POLISHING SURFACES

TECHNICAL FIELD

The present invention relates in general to a flexible abrasive in strip form, with or without holes, assembled or glued to a support or substrate made of woven or non-woven material or paper or Velcro or plastic film or sponge rubber or any combination of these.

This flexible abrasive has glued or applied abrasive strips and is shaped as required to form discs, strips, deltas, triangles, rolls or other commercial or special shapes.

In particular the invention relates to a flexible abrasive on a paper, cloth, non-woven material, plastic film or similar support and comprises a series of strips, with or without multiple holes, arranged alongside each on a suitable support which is formed to obtain the shaped required including discs, strips, deltas, triangles, rolls or other commercial or special shapes.

This product is designed to be highly flexible and can easily be adapted for the sanding of complex surfaces. It has excellent removal rates, a low tendency to clogging and is suitable for manual applications, use with tools and use on automatic and semi-automatic machine tools.

This invention can be applied in the field of abrasives and in particular in the sector of flexible abrasives and abrasive products in general. It can be applied in the automotive industry, in the woodworking and furniture making industry, in construction work, in the composite industry, in shipbuilding and in all those applications where shaped surfaces require treatment, a high quality surface finish and a high resistance to clogging.

BACKGROUND ART

It is well known in the automotive repair industry that repairing damaged bodywork parts also involves ensuring that it is not possible to see the difference between the repaired part and the rest of the vehicle. This is particularly the case of bodywork parts such as the bonnet, the boot, the doors, the bumpers and all those parts of the vehicle where flat and curved surfaces are together.

It is also known that in the woodworking and furniture making industry items of furniture and other furnishings in general comprise a variety of shapes, flat surfaces, sharp edges, concave and convex surfaces. When an item of furniture has some or all of these surface features it is essential that the surface finish is of the same quality in all parts of the item of furniture.

In the shipbuilding industry most of the surfaces present have concave or convex shapes. This is necessary not only for technical reasons but also because the shape of these surfaces fulfils an important aesthetic function.

In the construction industry new developments in design have brought with them the need to machine concave and convex surfaces. This is necessary not only for technical reasons but also because the shape of these surfaces often fulfils an important aesthetic function.

In general, many applications require sanding products that provide the same degree of finish on flat and shaped surfaces, maintain high removal rates, provide a high quality surface finish and have a low tendency to clog. In short, these products should be economical to use and provide a high quality surface finish which remains constant over time.

Usually these applications employ non-woven products or traditional abrasives on paper, fabric or plastic film backings in the form of abrasive discs or sheets.

Frequently, abrasives on paper or plastic film supports are preferred to abrasives applied to non-woven fabric supports because they offer superior abrasive performance and higher removal rates.

However, abrasives on paper or plastic film supports have the disadvantage that they are difficult to shape and have a limited range of shapes. In practice this means that they remove too much material in convex zones and too little material in concave zones. The limitations of traditional abrasives become most apparent when sanding large surfaces. Here a high degree of smoothness and uniformity is required which cannot be provided by traditional abrasives which leave behind their characteristic swirl marks.

It is notable that abrasives on non-woven fabric supports are preferred for machining complex, very curved surfaces. However, material removal rates are lower. An additional disadvantage of abrasives applied to non-woven fabric supports is that they do not maintain their cutting capacity for very long and the surface finish provided varies very rapidly.

The document WO 2011/087653 A1 describes a flexible abrasive product with a plurality of elongated channels extending across the work surface and intersecting with each other. These channels act as hinge points and improve the flexibility of the product in two or more directions. These channels assist in carrying the dust particles away from the sanding operation. There are optional openings designed to carry the dust particles away from the channels.

The document WO 01/04227 A2 describes an abrasive product comprising: a rigid backing or support with a first main surface and a second main surface; a plurality of abrasive ceramic compounds, each of which comprises a plurality of abrasive particles distributed inside a porous ceramic matrix; at least one metallic coating which fixes the ceramic abrasive compounds to at least one of the main surfaces of the backing support.

DESCRIPTION OF THE INVENTION

The present invention provides a new flexible abrasive designed to overcome the shortcomings of the known solutions as described above.

In particular the abrasive according to the invention solves the problems of abrasives applied to both non-woven fabric and traditional supports. More specifically, the invention provides an abrasive with high removal rates, which can be shaped to match the shape of various surfaces and which has a low tendency to clog. In addition, the product consists of abrasive strips and is therefore is more efficient in removing dust from the work surface thus making it a more user-friendly tool.

This is achieved by means of a flexible abrasive whose features are described in the main claim.

The dependent claims describe advantageous embodiments of the invention.

The present invention provides a flexible abrasive which comprises an abrasive surface consisting of a series of strips arranged alongside and parallel to each other on a backing support. Each strip is applied on a first support made from a woven or non-woven material and the abrasive surfaces are positioned alongside each other on the first support and advantageously separated from each other by a predefined distance to form at least one channel for aspirating the dusts and wastes produced during work. The channel bottom is formed by the upper surface of the first support and its walls are formed by the thicknesses of the two adjacent abrasive surfaces.

An important characteristic of the invention is that each strip applied to the first support is rectilinear and does not have inside it any channel for carrying away the dust. Rather, the channels for carrying the dust away are parallel to each other and defined by the distance which separate two parallel adjacent strips. This characteristic forms a finite number of channels for evacuating the dusts and where the channels do not communicate with each other but are parallel to each other. This characteristic greatly speeds up the transfer of dust to the outside of the device on which the abrasive is mounted.

A further advantageous characteristic of the present invention is that each strip is rectilinear and is made from a band having a width of at least 2.5 cm.

According to one embodiment of the present invention, the adjacent strips mounted on the same support can have different characteristics and abrasive parameters to each other so as to form an abrasive providing different types of performance. In this case a further characteristic could be to colour the various strips in different colours so as to enable immediate identification of the various types of abrasive applied to the support.

DESCRIPTION OF THE DRAWINGS

Other features and advantages of the invention will become clear on reading the description given below of one embodiment, provided as a non-binding example, with the help of the accompanying drawings, in which.

DESCRIPTION OF ONE EMBODIMENT OF THE INVENTION

Figure 1:
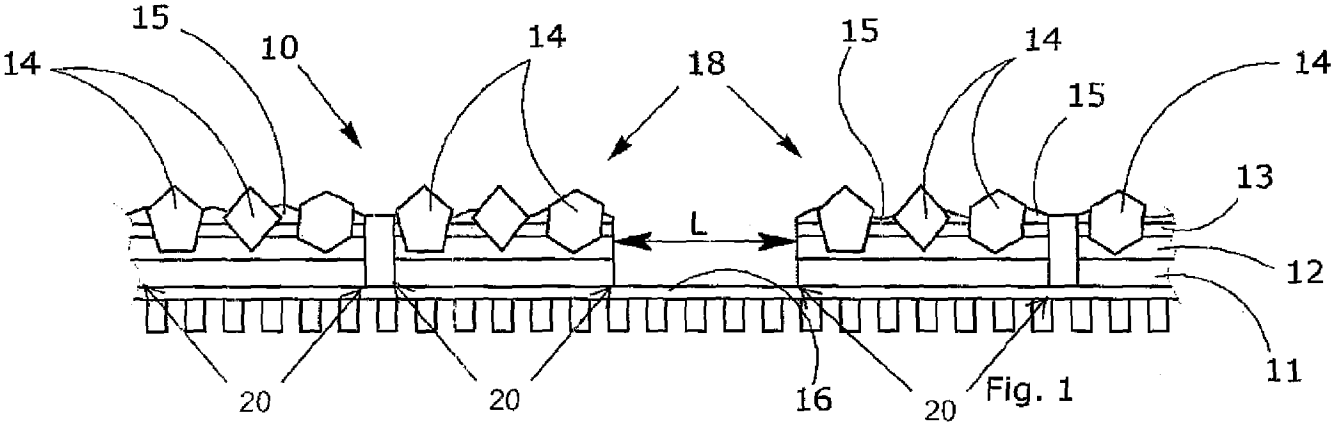
FIG. 1 is a cross-section of the flexible abrasive element according to the present invention in its entirety.

In FIG. 1 the number 10 indicates in its entirety the flexible abrasive according to the present invention made from a plurality of strips 20, arranged adjacent and parallel to one another and applied to a support 16 in the shape of a disc or other suitable shapes.

Each strip 20 can have a plurality of holes and comprises a support 11 (made from paper, woven or non-woven fabric or plastic or similar film) to which the abrasive grits 14 are applied by means of a first resin 12 and further held in place by means of a second resin 13.

A anti-clogging layer 15 can be applied to the strips in both versions, with or without holes.

Figure 3:
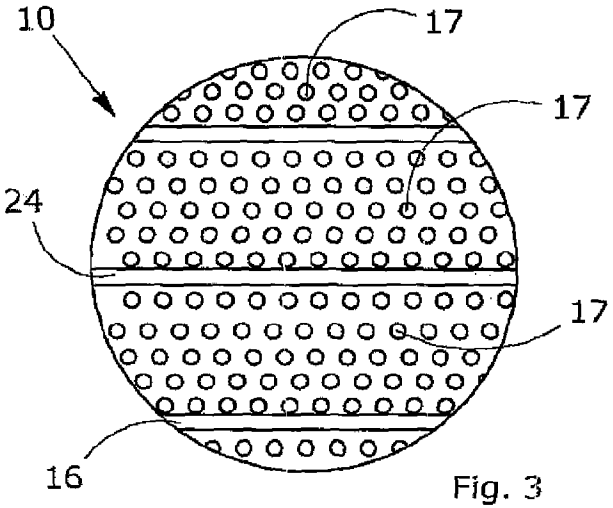
FIG. 3 is a front view similar to that in the previous figure with the difference that the abrasive part has holes.

The strips in the version shown in FIG. 3 have holes 17 whose shape, size and number depend on the application, the grit type and the support type. The strips 20 are applied with adhesives or other fixing systems to a woven or non-woven fabric support 16 which has eyelets which enable fixing to the backing plates or pads with Velcro.

These strips 20 can be applied to their support with adhesives or other fixing systems and also to woven or non-woven supports and supports made from sponge, paper, plastic film or similar or in any combination of these. These surfaces can have an adhesive treatment or a self-adhesive layer, for fixing to the backing plates or surfaces without Velcro, consisting of what is commonly known as PSA (pressure sensitive adhesive).

Figure 2:
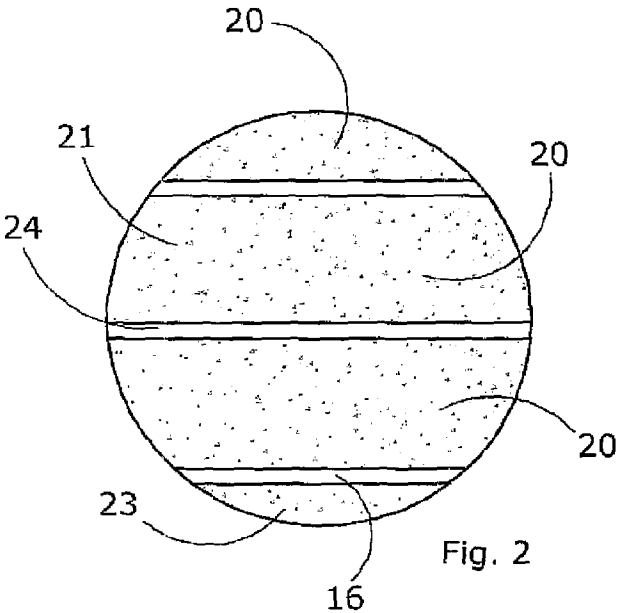
FIG. 2 shows a front view.
Figure 5:
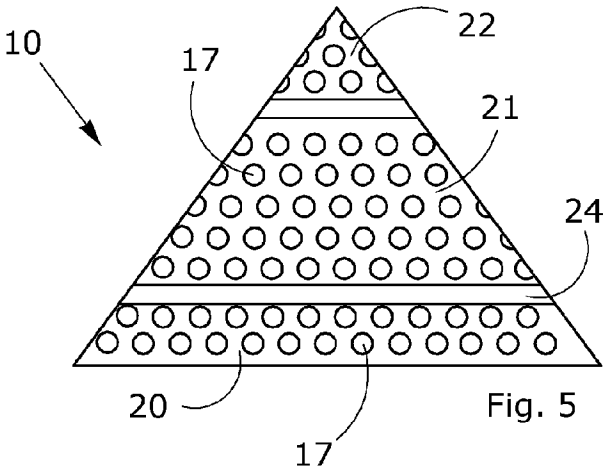
FIGS. 4 and 5 are diagrams showing the flexible abrasive according to the invention with a triangular shape, with and without holes.
Figure 4:
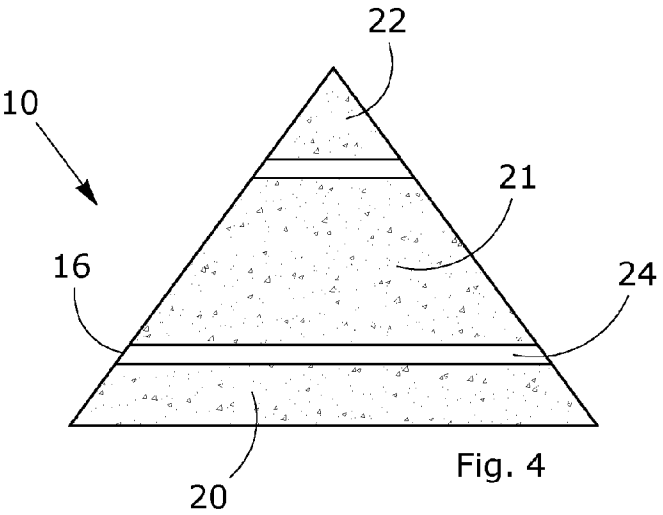
Figure 7:
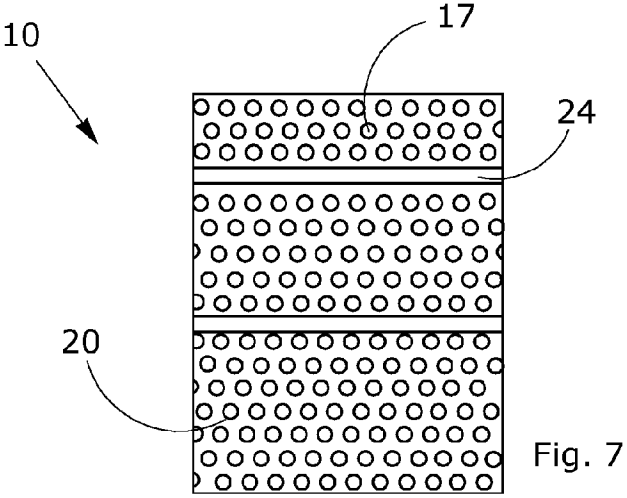
FIGS. 6 and 7 are diagrams showing the flexible abrasive according to the invention in a sheet form, with and without holes.
Figure 6:
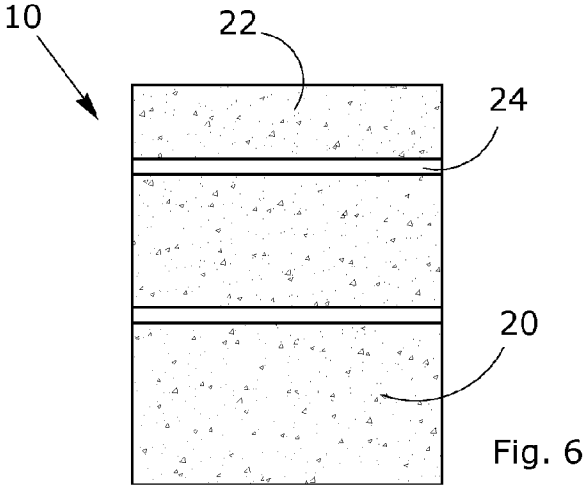

A support 16 made from woven or non-woven fabric fitted with strips prepared in this way and usually applied with adhesive to the support. This is then shaped to form discs as shown in FIGS. 2 and 3, or triangles as shown in FIGS. 4 and 5, or sheets as shown in FIGS. 6 and 7 so as to form an abrasive element indicated in its entirety by the reference number 10.

The abrasive element 10 with a preset shape corresponding to the shape of the operating head of a machine tool such as a sanding machine comprises:

- a first support 16 made from a woven or non-woven material where a lower surface can be fixed to a backing plate or a pad of the operating head;
- a series of strips 20-23 adjacent and parallel to each other where each strip has a second support 11 applied to the first support 10 and where the upper surface of each abrasive strip 20-23 has a plurality of abrasive grits 14 applied to the second support by a first resin 12 and fixed there by a second resin 13; an anti-clogging layer 15 can if required be fixed on the second resin 13.

The abrasive surface 18 of the abrasive element 10 is therefore made for a series of strips 20-23 parallel and adjacent to one another.

According to one of the advantageous characteristics of the invention, the strips 20-23 can be positioned on the first support 16 separated from each other by a preset distance "L" to form at least one channel 24, or advantageously a series of parallel channels, for aspirating the dusts and wastes during operation, whose bottom is formed by the upper surface of the first support 16 and whose walls are formed by the thicknesses of the two adjacent strips.

Each strip 20-23 can also comprise a plurality of holes 17 which form passages for the dusts and wastes formed during operation of the machine tool, and these holes 17 have a preset size and are separated from each other by a preset distance in order to prevent any clogging of the abrasive surface 18 defined by the strips during use of the abrasive element 10.

The second support 11 is made from paper or plastic film or from woven or non-woven material or similar.

The woven or non-woven material 16 which forms the first support is not subject to any specific restrictions regarding the type of material but it must be flexible, permit the aspiration of dusts and it must have eyelets or other fastening systems which permit its fixing to the backing plate or the Velcro surface. The base woven or non-woven material could be, for example, Velcro with a weight of between 45 and 300 g/m$^2$ made of nylon or polyester.

The woven or non-woven material must have a lengthways elongation to break point between 1% and 450% and a crossways elongation to break point between 1% and 450%.

In addition to woven or non-woven material it is also possible to use sponge, paper, plastic film or similar or a combination of these. These surfaces can have an adhesive treatment or a self-adhesive layer, for fixing to the backing plates or surfaces without Velcro, consisting of what is commonly known as PSA (pressure sensitive adhesive).

The flexible abrasive is formed by a support layer which can be paper, plastic film, woven material or similar to which adhesives or bonding resins of the phenolic, epoxy or similar types are applied. The purpose of these resins is to fix the abrasive grit to the support. The abrasive grit can be made from aluminium oxide, silicon carbide, zirconium, ceramics or similar. The grit is consolidated on the support by a further layer of adhesive or bonding resin of the phenolic, epoxy or similar type. The resins can also contain anti-clogging agents. Alternatively, an additional layer consisting of an anti-clogging agent such as calcium stearate can be applied.

The shape and dimensions of the abrasive strips can vary depending on, the application and the abrasive grit used. The abrasive strips can have straight or shaped edges. The abrasive strips must cover a surface of between 60% to 99% of the surface of the final abrasive product so that the space between the strips comprises between 1% and 40% of the total surface of the abrasive product.

The holes, where present, in these strips increase the capacity to aspirate dust for the work surface and help to reduce working temperatures. The size, number and shape of the holes is not specified and is determined on the basis of the application type, the grit and the type of abrasive used. Where present, the holes on each strip should cover between 0% and 50% of the total surface.

The abrasive product made in this way can be shaped to form discs, strips, deltas, triangles, sheets or other commercial or special shapes. These shaped products can be used manually mounted on pads or other types of support, can be used manually on tools, electric tools or compressed air tools or similar or can be used on semi-automatic or automatic machinery.

The number of strips and the distance between them depends on the size and shape of the final product. In general, each strip covers between 5% and 70% of the total surface.

The strips are manufactured in bands usually with a width of at least 2.5 cm. In addition the flexible abrasive 10 according to the present invention consists of strips mounted side by side which have grit of different sizes. This makes it possible to manufacture a flexible abrasive product which has different abrasive properties. In this case the strips making up the flexible abrasive can have different colours to facilitate identification by the user.

The invention is described in more detail in the example embodiment which follows.

Product 1

Product 1 comprises a flexible abrasive in the form of abrasive strips with multiple holes applied to a disc-shaped support.

The strips are prepared using a commercial product named Napoleon GF02-P320 and in this case made specifically in strips with multiple holes applied to a 150 g/m2 Velcro support with a polyurethane adhesive. This abrasive is then die-cut into discs with a diameter of 150 mm. The discs are applied to a soft interface.

Product 2

Product 2 comprises a commercial abrasive disc named Napoleon GF02-P320. The disc has a diameter of 150 mm, is without holes and is mounted on a Velcro support.

Product 3

Product 3 comprises a commercial abrasive disc named Napoleon GF02-P320. The disc has a diameter of 150 mm, has six holes and is mounted on a Velcro support.

Product 4

Product 4 comprises a commercial abrasive disc named Napoleon GF02-P320. The disc has a diameter of 150 mm, has 15 holes and is mounted on a Velcro support.

A "PUTTY" surface was prepared with a Mipa P99 Multi-Star bi-component putty (PE universal putty).

A "PRIMER" surface was prepared with a Mipa 2K-Primer AZ primer.

The surface to be machined was a curved metal sheet, 0.8 mm thick.

The compressed air power tool used to sand the surfaces was a Rupes Skorpio RH 156A orbital sander set to 11,000 rpm with a 6 mm orbit, a diameter of 150 mm. A medium backing pad was used. The pneumatic aspiration was on.

Removal Rate

| TYPE | PRODUCT # | Initial weight [g] | 1 MIN [g] | 2 MIN [g] | 3 MIN [g] | TOT [g] | Dust [g] |
|---|---|---|---|---|---|---|---|
| PRIMER | 1 | 2436 | 2433 | 2430 | 2427 | 9 | n/a |
| PRIMER | 2 | 2528 | 2526 | 2523 | 2520 | 8 | n/a |
| PRIMER | 3 | 2245 | 2243 | 2240 | 2238 | 7 | n/a |
| PRIMER | 4 | 2448 | 2446 | 2443 | 2441 | 7 | n/a |
| PUTTY | 1 | 2545 | 2537 | 2534 | 2528 | 17 | 0.4 |
| PUTTY | 4 | 3244 | 3238 | 3234 | 3231 | 13 | 3.2 |
| PUTTY | 3 | 3231 | 3224 | 3220 | 3217 | 14 | 2.5 |
| PUTTY | 2 | 2529 | 2522 | 2518 | 2514 | 15 | 1.1 |

The results in the table above show that the flexible abrasive according to the present invention has a high material removal rate. Product 1 is shaped to and follows the surface and therefore makes it possible to use the entire surface of the disc during sanding. This makes it possible to remove a greater quantity of material in the same sanding time.

The difference in removal rates is greater when sanding putty, an operation where a high removal rate is a critical parameter. It is interesting to note that the amount of dust left on the work surface by multi-hole strips is much less in comparison with no-hole or 15-hole discs (Products 2, 3 and 4). It was not possible to measure the amount of residual dust after sanding primer.

Finish

Surface roughness was measured using a Taylor Hobson Surtronic Duo portable roughness meter. Surface roughness was measured after the removal rate test on four different, representative points of the surface.

The table below shows the sanding results after three minutes on panels prepared with primer and putty.

| PRODUCT # | FORMAT | GRAIN-GRIT | 1 Ra μm | 1 Rz μm | 2 Ra μm | 2 Rz μm | 3 Ra μm | 3 Rz μm | 4 Ra μm | 4 Rz μm | AVERAGE Ra μm | AVERAGE Rz μm |
|---|---|---|---|---|---|---|---|---|---|---|---|---|
| After 3 minutes polishing on PRIMER | | | | | | | | | | | | |
| 2 | Ø150 | P320 | 0.39 | 2.40 | 0.41 | 3.10 | 0.40 | 2.80 | 0.46 | 3.20 | 0.42 | 2.88 |
| 3 | Ø150 | P320 | 0.42 | 2.75 | 0.39 | 2.50 | 0.44 | 3.10 | 0.49 | 3.50 | 0.44 | 2.96 |
| 4 | Ø150 | P320 | 0.49 | 3.44 | 0.44 | 3.91 | 0.40 | 2.85 | 0.50 | 3.54 | 0.46 | 3.44 |
| 1 | Ø150 | P320 | 0.34 | 2.30 | 0.43 | 2.70 | 0.37 | 2.60 | 0.44 | 3.20 | 0.40 | 2.70 |
| After 3 minutes polishing on PUTTY | | | | | | | | | | | | |
| 4 | Ø150 | P320 | 0.82 | 5.20 | 0.89 | 6.50 | 0.80 | 4.92 | 0.78 | 4.31 | 0.82 | 5.23 |
| 3 | Ø150 | P320 | 0.79 | 5.00 | 0.80 | 4.90 | 0.67 | 4.60 | 0.93 | 5.80 | 0.80 | 5.08 |
| 2 | Ø150 | P320 | 0.88 | 5.50 | 0.75 | 4.90 | 0.72 | 4.80 | 0.76 | 4.60 | 0.78 | 4.95 |
| 1 | Ø150 | P320 | 0.78 | 4.20 | 0.74 | 5.30 | 0.78 | 5.30 | 0.71 | 4.70 | 0.75 | 4.88 |

As the table shows, on PRIMER and on PUTTY the roughness readings of the abrasive strips in disc format (Product 1) are on average better than those for equivalent products in different formats.

Longevity

Product longevity was measured as the total sanding time on putty up until clogging took place.

| | Product # 1 | 2 | 3 | 4 |
|---|---|---|---|---|
| Time | 6 minutes 25 seconds | 5 minutes 10 seconds | 4 minutes 25 seconds | 3 minutes 10 seconds |

As the results show, Product 1 had a markedly greater longevity in comparison with competing products. This was due to the space between the abrasive strips and the holes in the strips which facilitate better aspiration of the dust.

The invention is described above with reference to a preferred embodiment. It is nevertheless clear that the invention is susceptible to numerous variations which lie within the scope of its disclosure, in the framework of technical equivalents.

The invention claimed is:

1. A method for manufacturing a flexible abrasive for polishing surfaces, said method comprising:

providing a first support made from a woven or non-woven material permitting the aspiration of dust, where the lower surface of said first support can be fixed to a backing plate or a pad of an operating head of a machine tool such as a polishing machine;

providing at least two rectilinear abrasive strips, each strip comprising a second support on which abrasive grits are applied by means of a first resin, wherein the strips have different grits in respect of each other;

applying separately said at least two rectilinear abrasive strips to said first support at a predetermined distance from each other, in such a way that said strips are parallel and adjacent to each other and define at least one channel for carrying away the dust generated during work;

shaping said support with said strips applied thereto in order to form a flexible abrasive whose shape corresponds to the shape of said operating head of a machine tool such as a polishing machine.

2. The method according to claim 1, wherein at least one strip also comprises a plurality of holes which form passages for the dusts and wastes formed during operation of the machine tool, and wherein the holes have a preset size and are separated from each other by a preset distance in order to prevent any clogging of the abrasive surface and/or the holes during use of the abrasive element.

3. The method according to claim 1, wherein the second support is made from paper or plastic film or from woven or non-woven material or similar, whereby said second support is applied to said first support by means of an adhesive.

4. The method according to claim 1, comprising applying a second resin to the second support, wherein the second resin holds for the abrasive grits in place.

5. The method according to claim 4, wherein an anti-clogging agent applied on top of the resin.

6. The method according to claim 1, wherein said flexible abrasive is either shaped as a disc, or as a delta or as a sheet of a plurality of parallel stripes separated by a plurality of channels.

7. The method according to claim 1, wherein the strips with different grits have different surface colours.

8. The method according to claim 1, wherein in the abrasive surface covers between 60% to 99% of the total surface of the backing plate or pad of the head and that the space between the strips comprises between 1% and 40% of the total surface.

9. The method according to claim 1, wherein the first support is made from nylon or polyester Velcro® with a weight between 45 and 300 g/m2.

10. The method according to claim 1, wherein the first support has a lengthways elongation to break point between 1% and 450% and/or a crossways elongation to break point between 1% and 450%.

11. The method according to claim 1, wherein the strips are made from a band having a width of at least 2.5 cm.

* * * * *